US007581928B1

(12) United States Patent
Cunha

(10) Patent No.: US 7,581,928 B1
(45) Date of Patent: Sep. 1, 2009

(54) SERPENTINE MICROCIRCUITS FOR HOT GAS MIGRATION

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 448 days.

(21) Appl. No.: 11/494,831

(22) Filed: Jul. 28, 2006

(51) Int. Cl.
*F01D 5/18* (2006.01)
*F01D 5/08* (2006.01)

(52) U.S. Cl. ..... 416/97 R; 415/115

(58) Field of Classification Search ..... 415/115, 415/116; 416/95, 96 R, 97 R, 97 A
See application file for complete search history.

(56) References Cited

U.S. PATENT DOCUMENTS 3,191,908 A * 6/1965 Petrie et al. ..... 416/96 R
5,348,446 A * 9/1994 Lee et al. ..... 416/241 R
5,667,359 A * 9/1997 Huber et al. ..... 416/96 A
5,813,835 A * 9/1998 Corsmeier et al. ..... 416/97 R
6,036,441 A * 3/2000 Manning et al. ..... 416/97 R
7,416,390 B2 * 8/2008 Liang ..... 416/97 R
2005/0265837 A1 12/2005 Liang

FOREIGN PATENT DOCUMENTS

| | | |
|---|---|---|
| EP | 1091091 | 4/2001 |
| EP | 1267038 | 12/2002 |
| EP | 1420142 | 5/2004 |
| EP | 1586739 | 10/2005 |

* cited by examiner

*Primary Examiner*—Igor Kershteyn
(74) *Attorney, Agent, or Firm*—Bachman & LaPointe, P.C.

(57) ABSTRACT

A turbine engine component, such as a turbine blade, has an airfoil portion with a pressure side and a suction side. The turbine engine component also has a first cooling circuit within the pressure side for cooling the pressure side of the airfoil portion and a second cooling circuit within the suction side for cooling the suction side of the airfoil portion and for cooperating with a wrap around leading edge cooling circuit for creating a cooling film over the pressure side.

16 Claims, 4 Drawing Sheets

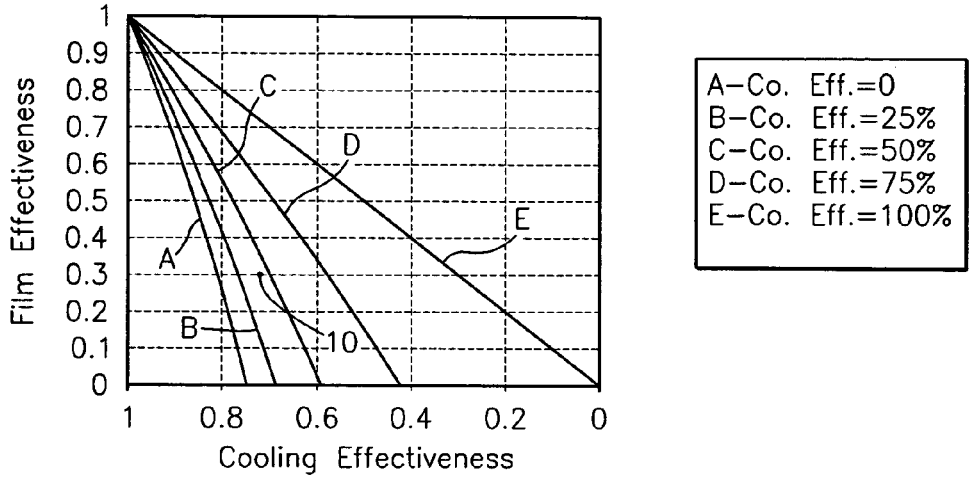
*FIG. 1*
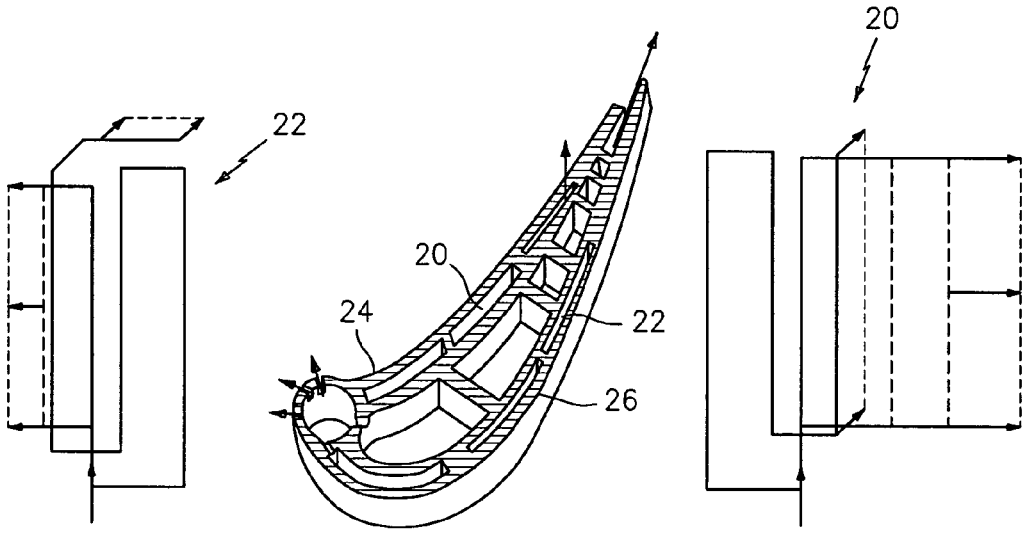
*FIG. 2C* *FIG. 2A* *FIG. 2B*

SERPENTINE MICROCIRCUITS FOR HOT GAS MIGRATION

BACKGROUND (1) Field of the Invention

The present invention relates to a turbine engine component having an improved scheme for cooling an airfoil portion.

(2) Prior Art

The overall cooling effectiveness is a measure used to determine the cooling characteristics of a particular design. The ideal non-achievable goal is unity, which implies that the metal temperature is the same as the coolant temperature inside an airfoil. The opposite can also occur when the cooling effectiveness is zero implying that the metal temperature is the same as the gas temperature. In that case, the blade material will certainly melt and burn away. In general, existing cooling technology allows the cooling effectiveness to be between 0.5 and 0.6. More advanced technology such as supercooling should be between 0.6 and 0.7. Microcircuit cooling as the most advanced cooling technology in existence today can be made to produce cooling effectiveness higher than 0.7.

FIG. 1 shows a durability map of cooling effectiveness (x-axis) vs. the film effectiveness (y-axis) for different lines of convective efficiency. Placed in the map is a point 10 related to a new advanced serpentine microcircuit shown in FIGS. 2*a*-2*c*. This serpentine microcircuit includes a pressure side serpentine circuit 20 and a suction side serpentine circuit 22 embedded in the airfoil walls 24 and 26.

The Table I below provides the operational parameters used to plot the design point in the durability map.

TABLE I

| Operational Parameters for serpentine microcircuit | |
|---|---|
| beta | 2.898 |
| Tg | 2581 [F] |
| Tc | 1365 [F] |
| Tm | 2050 [F] |
| Tm_bulk | 1709 [F] |
| Phi_loc | 0.437 |
| Phi_bulk | 0.717 |
| Tco | 1640 [F] |
| Tci | 1090 [F] |
| eta_c_loc | 0.573 |
| eta_f | 0.296 |
| Total Cooling Flow | 3.503% |
| WAE | 10.8 |

Legend for Table I
Beta = heat load
Phi bc = local cooling effectiveness
Phi_bulk = bulk cooling effectiveness
Eta_c_bc = local cooling efficiency
Eta_f = film effectiveness
Tg = gas temperature
Tc = coolant temperature
Tm = metal temperature
Tm_bulk = bulk metal temperature
Tco = exit coolant temperature
Tci = inlet coolant temperature
WAE = compressor engine flow, pps It should be noted that the overall cooling effectiveness from the table is 0.717 for a film effectiveness of 0.296 and a convective efficiency (or ability to pick-up heat) of 0.573. Also note that the corresponding cooling flow for a turbine blade having this cooling microcircuit is 3.5% engine flow. FIG. 3 illustrates the cooling flow distribution for a turbine blade with the serpentine microcircuits of FIGS. 2*a*-2*c* embedded in the airfoils walls.

There are however field problems that can be addressed efficiently with peripheral microcircuit designs. One such field problem is illustrated in FIGS. 4A and 4B. In FIG. 4A, the streamlines of the gas path close to the external surface of the airfoil illustrate four different regions in which the gas flow changes direction or migration: a tip region, two mid-section regions, and a root region. In between the tip and the upper mid region, the flow transitions through a pseudo stagnation point(s). The momentum of the external gas seems to decelerate in such a way as to impose a local thermal load to the part. This manifests itself by regions where the propensity for erosion and oxidation increase in the airfoil surface. The superposition of FIG. 4B illustrates the local coincidence between the pseudo-stagnation region and the blade distress in the part surface. In the mid region, the upper and lower region also converge onto one another, but even though the space between streamlines decreases, the flow seems to accelerate and there is no pseudo-stagnation regions. A mild manifestation of the same tip-to-mid phenomena seems to initiate in the transition region between the mid-to-root regions. It is therefore necessary to tailor the peripheral microcircuit in such a manner as to address these local high thermal load regions.

SUMMARY OF THE INVENTION

In accordance with the present invention, a turbine engine component is provided with improved cooling. The turbine engine component broadly comprises an airfoil portion having a pressure side and a suction side. The turbine engine component further has a first cooling circuit within the pressure side for cooling the pressure side of the airfoil portion and a second cooling circuit within the suction side for cooling the suction side of the airfoil portion and for cooperating with means for creating a cooling film over the pressure side.

Other details of the serpentine microcircuits for hot gas migration of the present invention, as well as other objects and advantages attendant thereto, are set forth in the following detailed description and the accompanying drawings wherein like reference numerals depict like elements.

BRIEF DESCRIPTION OF THE DRAWINGS

FIG. 1 is a graph showing cooling effectiveness versus film effectiveness for a turbine engine component;

FIG. 2A shows an airfoil portion of a turbine engine component having a pressure side cooling microcircuit embedded in the pressure side wall and a suction side cooling microcircuit embedded in the suction side wall;

FIG. 2B is a schematic representation of a pressure side cooling microcircuit used in the airfoil portion of FIG. 2A;

FIG. 2C is a schematic representation of a suction side cooling microcircuit used in the airfoil portion of FIG. 2A;

DETAILED DESCRIPTION OF THE PREFERRED EMBODIMENT(S)

Figure 5:
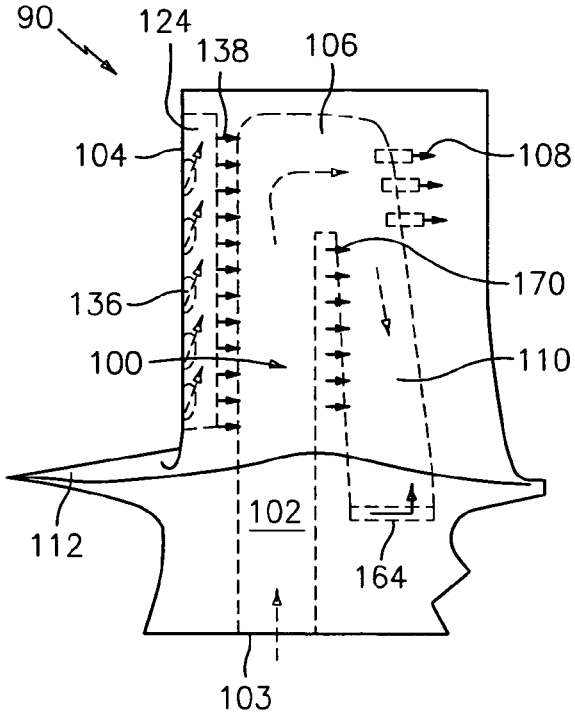
FIG. 5 is a schematic representation of a peripheral pressure side cooling circuit.
Figure 6:
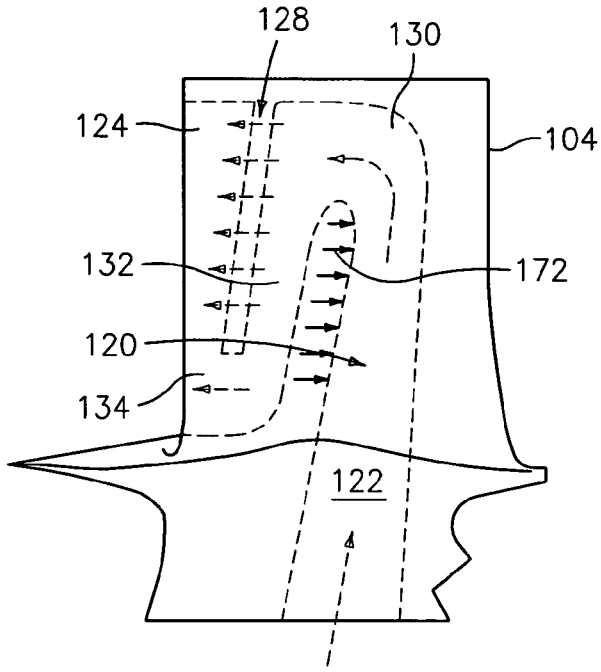
FIG. 6 is a schematic representation of a peripheral suction side cooling circuit.

Referring now to FIGS. 5 and 6, there are depicted two peripheral cooling arrangements which may be used to address local increases in the airfoil thermal load of a turbine engine component 90 such as a turbine blade. The two peripheral cooling arrangements include a peripheral pressure side microcircuit 100 which may be incorporated or embedded within the wall forming the pressure side of an airfoil portion 104 and a suction side microcircuit 120 which may be incorporated or embedded within the wall forming the suction side of the airfoil portion 104.

Figure 3:
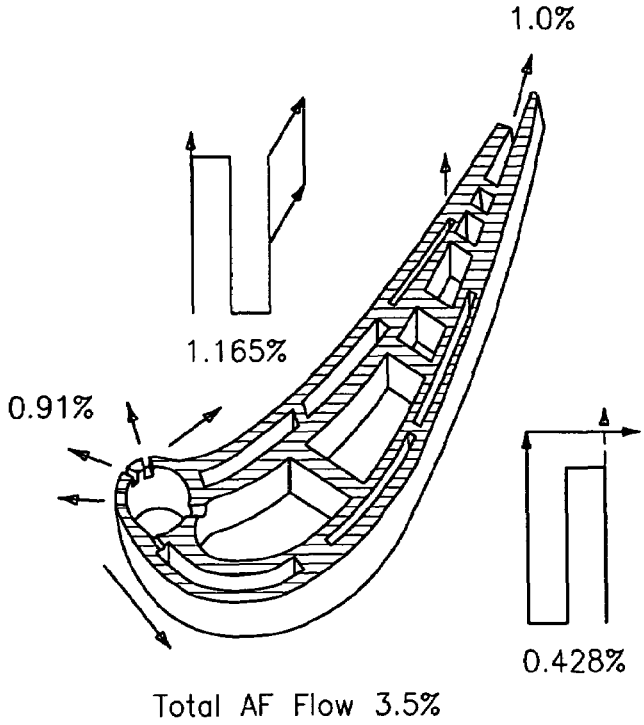
FIG. 3 illustrates the cooling flow distribution for a turbine engine component with serpentine microcircuits embedded in the airfoil walls.
Figure 4A:
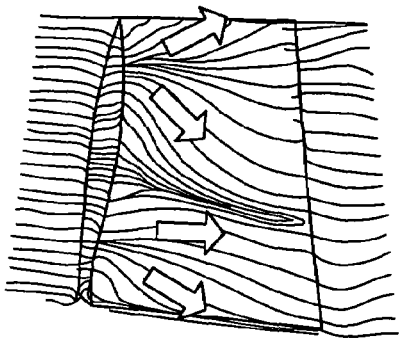
FIG. 4A is a schematic representation illustrating the pressure side distress on an airfoil surface.
Figure 4B:
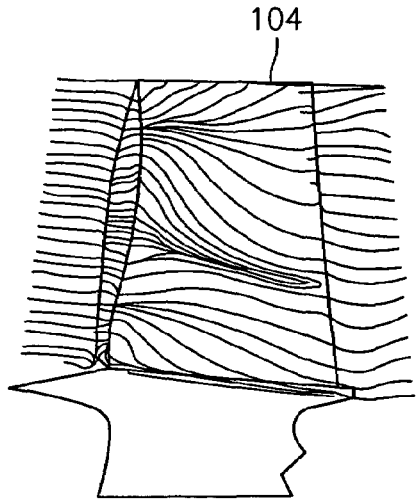
FIG. 4B is a schematic representation of the local coincidence between the pseudo-stagnation region and the blade distress.

In FIG. 5, the pressure side peripheral microcircuit 100 is shown. In this circuit, the first leg 102 has an inlet 103 which receives cooling fluid from a source (not shown). The leg 102 provides a flow of cooling fluid which quenches the hot spot in the tip-to-mid region of the airfoil portion 104 shown in FIG. 4B. The cooling fluid within the leg 102 proceeds around a 180 degree bend 106 which is supplemented with a plurality of film holes 108, preferably three film holes. The film holes 108 ensure flow acceleration through the bend 106 to a second downstream leg 110 which ends below the platform 112 of the turbine engine component 90 in an exit 164. Cooling fluid from the leg 110 is fed into an internal trailing edge circuit 114 to be discussed hereinafter via the exit 164 where it is used to further cool the airfoil portion 104.

Referring now to FIG. 6, there is shown a peripheral suction side microcircuit 120. The circuit 120 has a first leg 122 which communicates with a source (not shown) of cooling fluid. In the first leg 122, the cooling flow convects heat away from the suction side. Since the circuit 120 has no film holes, effective cooling may not be done past the external gage point of the airfoil portion 104 where any film cooling would provide high aerodynamic penalties due to mixing. (PLEASE CHECK THIS TO SEE IF IT MAKES SENSE) Thus, the circuit 120 is used to feed cooling fluid to a leading edge microcircuit 124 which wraps around the leading edge 126 of the airfoil portion 104. The circuit 120 feeds or supplies cooling fluid to the leading edge wrap around circuit 124 through a plurality of wall cross over holes 128. As can be seen from FIG. 6, the circuit 120 has a bend 130 and a second leg 132. The holes 128 are preferably located in the vicinity of the bend 130 and the second leg 132. The second leg 132 may also communicate with the wrap around circuit 124 via a passageway 134. As the microcircuit 124 wraps around the leading edge, several holes 136 are located in the leading edge and are used to cool the leading edge of the airfoil portion 104. Further, the microcircuit 124 is provided with a plurality of film holes 138 for creating a film of cooling fluid over the pressure side of the airfoil portion.

Figure 7:
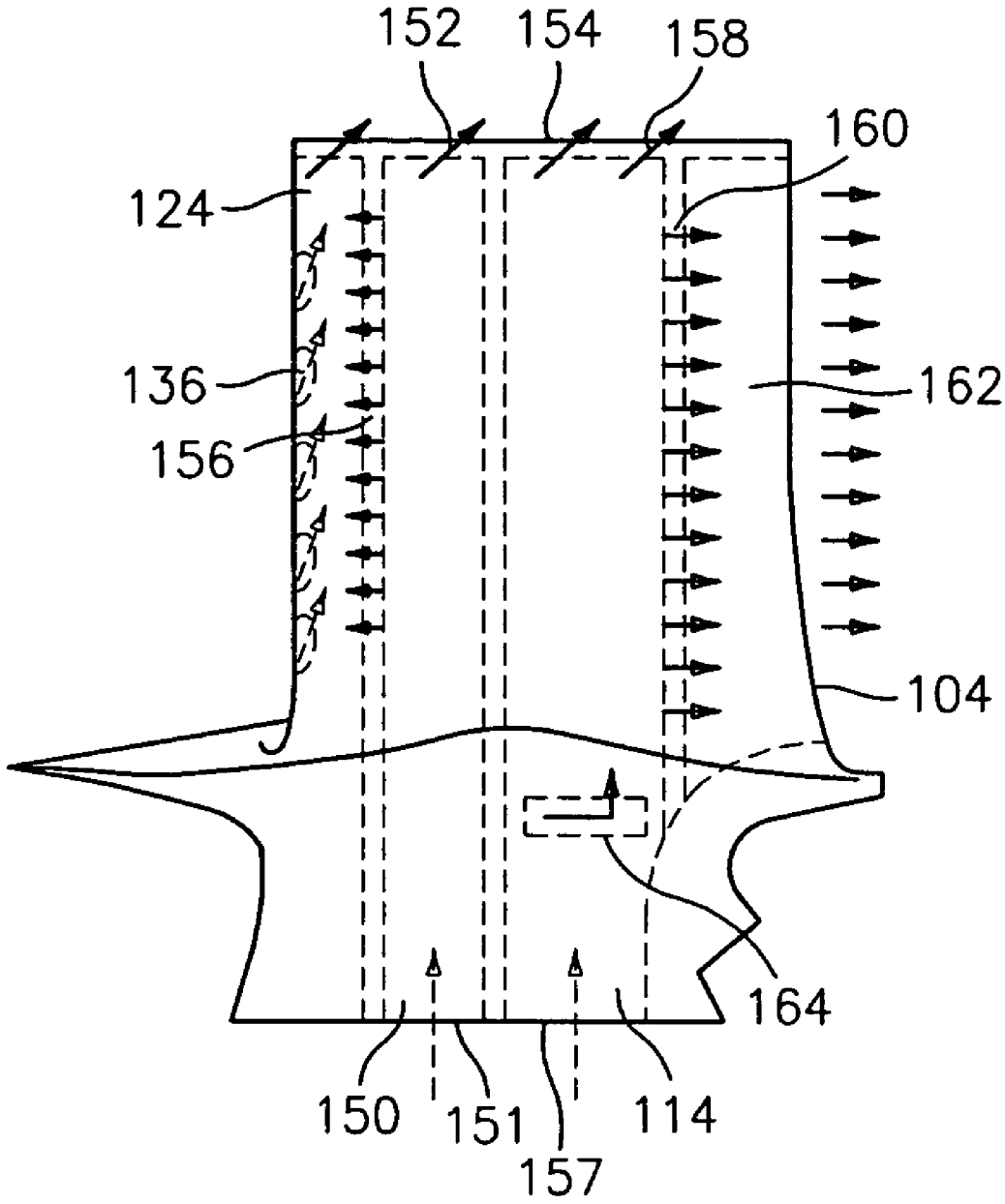
FIG. 7 is a schematic representation of main body internal cooling circuits.

Referring now to FIG. 7, there is shown the main body internal cooling circuits which include a leading edge internal cooling circuit 150 and the trailing edge internal cooling circuit 114. The leading edge internal cooling circuit 150 communicates with a source (not shown) of cooling fluid, such as engine bleed air, via an inlet 151 and has one or more film cooling holes 152 adjacent the tip 154 of the airfoil portion 104 to provide tip cooling. The circuit 150 also has a plurality of cross-over holes 156 for supplying cooling fluid to the leading edge microcircuit 124.

The trailing edge internal circuit 114 also communicates with a source (not shown) of cooling fluid, such as engine bleed air, via an inlet 157 and has one or more film cooling holes 158 adjacent the tip 154 to provide tip cooling. The circuit 114 also has a plurality of cross-over holes 160 for communicating with a trailing edge cooling circuit 162 for cooling the trailing edge of the airfoil portion 104. As can be seen from FIG. 7, the tailing edge internal circuit 114 also receives cooling fluid from the peripheral pressure side microcircuit 100 via the exit 164.

Each of the leading edge internal circuit 150 and the trailing edge internal circuit 114 may be provided with a plurality of film cooling holes 170 and 172 respectively to form cooling films over the pressure and suction sides of the airfoil portion 104.

Using the pressure and suction side cooling circuits of the present invention, the airfoil portion of a turbine engine component may be very effectively convectively cooled. Using the pressure side circuit, the cooling flow is returned to the trailing edge internal circuit for further cooling of the airfoil. Using the suction side circuit, the leading edge of the airfoil is cooled first before discharging in pressure side film. This effective use of coolant allows for positive effects on cycle thermodynamic efficiency, turbine efficiency, rotor inlet temperature impacts, and specific fuel consumption.

It is apparent that there has been provided in accordance with the present invention serpentine microcircuits for hot gas migration which fully satisfy the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a pressure side and a suction side;

a first cooling circuit within said pressure side for cooling said pressure side of said airfoil portion;

a second cooling circuit within said suction side for cooling said suction side of said airfoil portion and for cooperating with means for creating a cooling film over said pressure side;

a trailing edge internal circuit; and said first cooling circuit having an exit which delivers cooling fluid to said trailing edge internal circuit.

2. The turbine engine component according to claim 1, wherein said means for creating a cooling film over said pressure side comprises a cooling circuit wrapped around a leading edge of said airfoil portion.

3. The turbine engine component according to claim 2, further comprising said cooling circuit wrapped around said leading edge having a first set of film holes for cooling said leading edge.

4. The turbine engine component according to claim 3 further comprising said cooling circuit wrapped around said leading edge having a second set of film holes for cooling said pressure side of said airfoil portion.

5. The turbine engine component according to claim 1, further comprising a leading edge internal circuit.

6. The turbine engine component according to claim 1, wherein said first cooling circuit has a first leg, a second leg, and a bend between said first leg and said second leg.

7. The turbine engine component according to claim 6, wherein said second leg terminates in said exit.

8. The turbine engine component according to claim 6, further comprising means for ensuring flow acceleration through the bend.

9. The turbine engine component according to claim 8, wherein said flow acceleration ensuring means comprises a plurality of holes.

10. The turbine engine component according to claim 5, wherein each of said internal circuits has a plurality of film holes for creating a flow of cooling fluid over said pressure side and said suction side.

11. The turbine engine component according to claim 5, wherein said leading edge internal circuit has a plurality of cross-over holes for supplying fluid to a leading edge cooling circuit.

12. The turbine engine component according to claim 5, wherein said trailing edge internal circuit has a plurality of cross-over holes for supplying fluid to a trailing edge cooling circuit.

13. A turbine engine component comprising:

an airfoil portion having a pressure side and a suction side;

a first cooling circuit within said pressure side for cooling said pressure side of said airfoil portion;

a second cooling circuit within said suction side for cooling said suction side of said airfoil portion and for cooperating with means for creating a cooling film over said pressure side;

a leading edge internal circuit and a trailing edge internal circuit; and wherein each of said leading edge and said trailing edge internal circuits has means for cooling a tip of said airfoil portion.

14. A turbine engine component comprising:

an airfoil portion having a pressure side and a suction side;

a first cooling circuit within said pressure side for cooling said pressure side of said airfoil portion;

a second cooling circuit within said suction side for cooling said suction side of said airfoil portion and for cooperating with means for creating a cooling film over said pressure side; and wherein said second cooling circuit has a first leg, a second leg, and a bend between said first leg and said second leg.

15. The turbine engine component according to claim 14, wherein said second cooling circuit has a plurality of cross-over holes for supplying cooling fluid to said means for creating a cooling film over said pressure side.

16. The turbine engine component according to claim 14, wherein said second leg communicates with said means for creating a cooling film over said pressure side.

* * * * *

UNITED STATES PATENT AND TRADEMARK OFFICE

CERTIFICATE OF CORRECTION

PATENT NO. : 7,581,928 B1
APPLICATION NO. : 11/494831
DATED : September 1, 2009
INVENTOR(S) : Francisco J. Cunha It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 483 days.

Signed and Sealed this

Fourteenth Day of September, 2010

David J. Kappos

David J. Kappos
*Director of the United States Patent and Trademark Office*